US011515612B2

(12) United States Patent
Ghezzo et al.

(10) Patent No.: US 11,515,612 B2
(45) Date of Patent: Nov. 29, 2022

(54) PORTABLE SATELLITE ANTENNA

(71) Applicant: HI-TE S.R.L., Goro (IT)

(72) Inventors: Enrico Ghezzo, Ferrara (IT); Antonello Giovannelli, Ferrara (IT)

(73) Assignee: HI-TE S.R.L.

( * ) Notice: Subject to any disclaimer, the term of this patent is extended or adjusted under 35 U.S.C. 154(b) by 0 days.

(21) Appl. No.: 17/266,582

(22) PCT Filed: Aug. 3, 2019

(86) PCT No.: PCT/IB2019/056627
§ 371 (c)(1),
(2) Date: Feb. 6, 2021

(87) PCT Pub. No.: WO2020/031049
PCT Pub. Date: Feb. 13, 2020

(65) Prior Publication Data

US 2021/0313667 A1 Oct. 7, 2021

(30) Foreign Application Priority Data

Aug. 7, 2018 (IT) ..... 202018000003195

(51) Int. Cl.
*H01Q 1/27* (2006.01)
*H01Q 1/08* (2006.01)

(52) U.S. Cl.
CPC ..... *H01Q 1/08* (2013.01); *H01Q 1/273* (2013.01)

(58) Field of Classification Search
CPC ..... H01Q 1/08; H01Q 1/085; H01Q 1/088; H01Q 1/1235; H01Q 1/273
See application file for complete search history.

(56) References Cited

U.S. PATENT DOCUMENTS

| | | | | |
|---|---|---|---|---|
| 4,053,896 | A | 10/1977 | Bitter, Jr. et al. | |
| 3,055,209 | A1 | 11/2011 | Dao | |
| 2008/0094308 | A1 | 4/2008 | Cowles | |
| 2011/0221646 | A1 | 9/2011 | Dresel et al. | |
| 2012/0280869 | A1 | 11/2012 | Kirkham | |
| 2016/0197397 | A1 * | 7/2016 | Pryor | H01Q 9/16 343/718 |
| 2017/0310013 | A1 | 10/2017 | Muesse et al. | |

OTHER PUBLICATIONS

International Search Report and Written Opinion of the International Searching Authority, International Application No. PCT/IB2019/056627, dated Jan. 19, 2021, 12 pages.

* cited by examiner

*Primary Examiner* — Daniel Munoz
(74) *Attorney, Agent, or Firm* — Ware, Fressola, Maguire & Barber LLP

(57) ABSTRACT

A portable satellite antenna (1) includes radiating elements (2), made of flexible shape memory material, attached to a main body (3) acting as a handle. In operation (W) of the antenna elements (2) are arranged in a fan-like radial pattern (X). When not operational (H) they are folded in a position (R) in which they adhere to the main body (3). For the definition and maintenance of the radiating elements (2) in the folded position (R), means of stabilization (4) are provided, such as a cap (40) or a band (41), or even a collar (42) or a sleeve (43), to be associated, in a fixed or removable way, to the main body (3) and radiating elements (2), which are capable of spontaneously returning to the fan-like radial configuration (X), corresponding to operation (W) of the antenna (1), as a result of the removal/opening of the means of stabilization (4).

13 Claims, 2 Drawing Sheets

PORTABLE SATELLITE ANTENNA

TECHNICAL FIELD

The present invention relates to the technical field of RF telecommunications.

In particular, the invention concerns a handheld satellite antenna, suitable for portable or transportable radio transmitters.

BACKGROUND ART

As is well known, satellite communications, both civil and military, exploit the availability of "bridge" or link satellites to extend the range of mobile radio communication systems, or in any case distributed over the territory.

For this purpose, the above mentioned radio communication systems are provided, according to known techniques, with satellite transceivers ("SATCOM") suitably piloted and connected to other transceiver equipment, served by dedicated antennas.

Satellite radio communications equipment includes antennas normally having an omnidirectional radiation pattern in the horizontal plane and a circular polarization coordinated with the direction of rotation of that of the antenna on board the satellite.

Satellite antennas of this type are often of the crossed dipole type, i.e. including two crossed rods, arranged on the same horizontal plane, and electrically connected in such a way as to result in a ninety electrical degrees phase offset, and in this way they obtain the necessary circular polarization.

In particular, there are well-known portable satellite antennas, built in such a way as to be able to be gripped and oriented manually, for greater immediacy and convenience of use.

Such handheld antennas are structurally made up of a main body that acts as a handle, from which radially extend, in a plane substantially perpendicular to the axis of said stem, the radiating elements of the antenna, like the ribs of an umbrella.

TECHNICAL PROBLEM

As can be intuitively understood, folding the above mentioned radiating elements close to the main body can be very useful when the antenna is not used, both to reduce its dimensions and to safeguard the integrity of the radiating elements themselves.

A known technical solution requires that the radiating elements are articulated to the main body by means of hinged joints, so as to be able to fold them adherent to the latter in a condition of non-use.

In order to obtain stability in the open position, suitable parts must be associated to the hinged joints, for example clutch or screw, that prevent the reclosing of one or more elements during the use of the antenna, with possible interruptions of the connection.

Apart from the relative mechanical complication, the unfolding and folding maneuvers must be done for each individual radiating element, with an obvious loss of time which, particularly if one considers a military deployment, becomes unacceptable, for obvious reasons of timeliness.

Since these antennas are to be used while being handheld, it is reasonable to expect that they will be carried substantially "on the shoulder" together with other equipment, or that they will be housed in vehicles, either military or civilian, in which taking up a minimum space is an important requirement; therefore, in such devices, higher weights and larger encumbrances are more disadvantageous.

OBJECTS OF THE INVENTION

The main object of this invention is therefore to propose an improved portable satellite radio communications antenna that allows to overcome the inconvenience complained of with the known technique, making it much easier and faster to switch the antenna from the inoperative position, with the radiating elements adhering to the stem, to the operational one, with the radiating elements in the fan-like arrangement, and vice versa.

Another object of the invention is to obtain the above mentioned best functionality with a simple and low cost technical solution.

Yet another object of the invention is to adopt technical solutions that allow the maximum compactness and lightness of the antenna, so as to make it easy for the operator to transport it.

A further object of the invention is to produce an antenna in which the radiating elements, when folded in the closed position are as much as possible protected from damages.

SUMMARY OF THE INVENTION

These and other objects are wholly obtained by an improved satellite radio communications antenna of the type including radiating elements fastened to a main body acting as a handle, fan-like extended from the latter in an operating condition and foldable so as to adhere to the same main body in the condition of non-use of said satellite antenna, the latter including:

means of stabilization associated, whether fixed or removable, with said radiating elements for the definition and maintenance of the same elements in the said folded position adhering to that main body, and with said radiating elements intended to return spontaneously to said fan-like radial configuration, corresponding to the said operating condition of said satellite antenna, as a result of the removal/opening of said means of stabilization.

BRIEF DESCRIPTION OF THE DRAWINGS

The characteristics of the invention in question will be evident from the following description of preferred embodiments of the inventive improved antenna for satellite radio communications, in accordance with what is proposed in the claims and with the help of the attached drawings, in which:

DESCRIPTION OF EMBODIMENTS

Figure 2A:
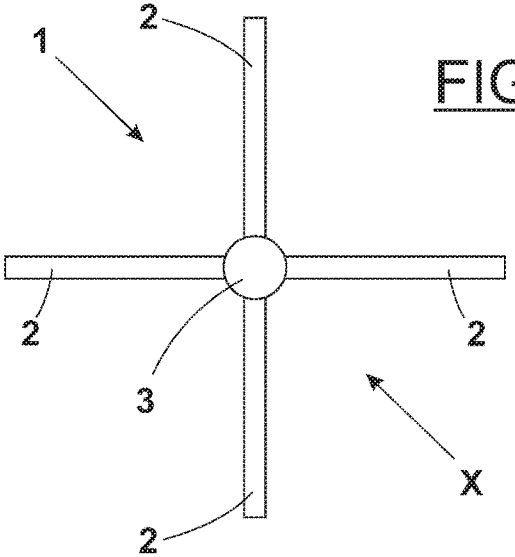
FIG. 2A shows a top view of the antenna of FIG. 1.

In the above figures, reference numeral 1 has been used to indicate, as a whole, an improved portable satellite radio communications antenna of the cross dipole type, which is the subject of the present invention.

Figure 1:
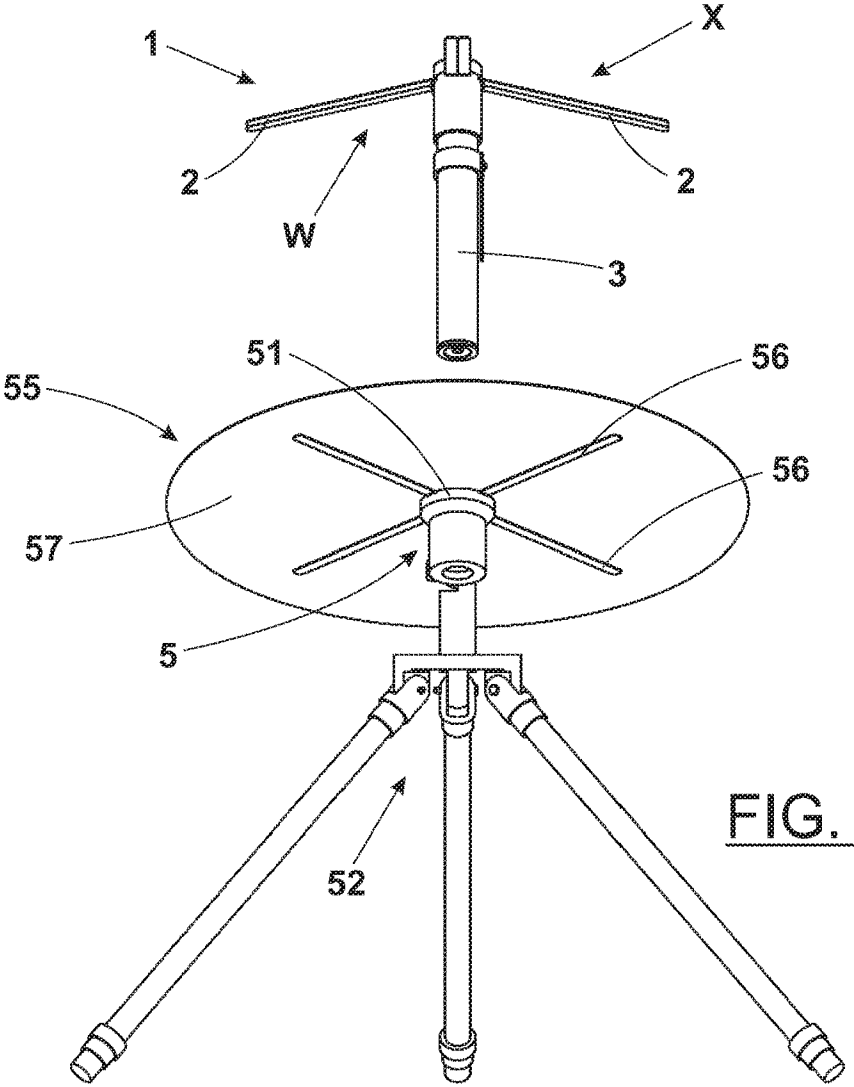
FIG. 1 shows, in axonometric view, an antenna according to the invention, in condition of use.

Antenna 1 includes, in a way that is per se known, radiating elements 2, for example four elements angularly spaced (FIGS. 1 and 2A), fixed in a fan-like arrangement to a main body 3 acting as a handle, since the antenna 1 is of the type intended to be held by hand.

The main body 3 also contains all the electronics needed to operate the antenna 1, and the connector(s) needed to connect it to an external SATCOM transceiver.

Figure 2B:
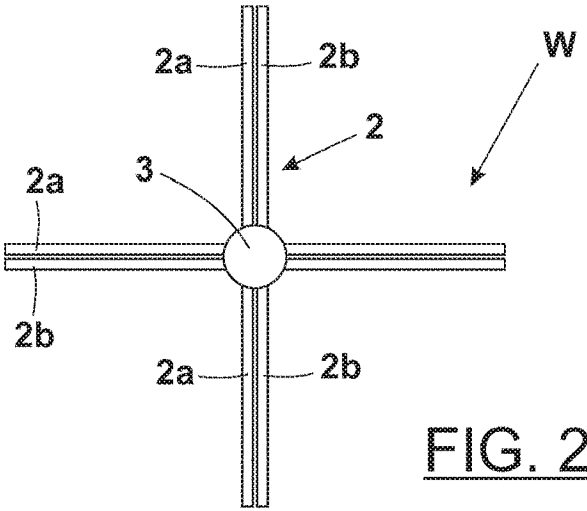
FIG. 2B shows a view similar to FIG. 2A of a different embodiment of the antenna.

In a constructive variant of antenna 1, each of said radiating elements 2 includes a pair 2*a*, 2*b*, with each pair 2*a*, 2*b* angularly equidistanced from the others, when arranged in the fan-like radial configuration; preferably, the two radiating elements 2*a*, 2*b* of each pair are substantially parallel and aligned on the same plane (FIG. 2B).

The radiating elements 2, in operating condition W of the antenna 1, are extended in a fan-like fashion from the main body 3 (FIGS. 1 and 2A) and are suitable to be folded to adhere to the latter in condition of non-use H of the same satellite antenna 1.

According to the invention, the radiating elements 2 are made of flexible memory shaped material, consisting for example of metal such as harmonic steel, coated with silicone or other plastic material.

In the absence of external stress, the radiating elements 2 are arranged in the fan-like configuration X, in which the antenna 1 is in operating condition W.

In order to move and hold these radiating elements 2 into the above mentioned folded position R adhering to said main body 3, means of stabilization 4 are provided which are associated, in a fixed or removable way, with the same radiating elements 2 and main body 3.

In a first embodiment, the means of stabilization 4 are made up of a tubular cap 40 intended to be fitted on the aforementioned main body 3, with movement from top to bottom.

Figures 3, 4, 5, 6, 7:
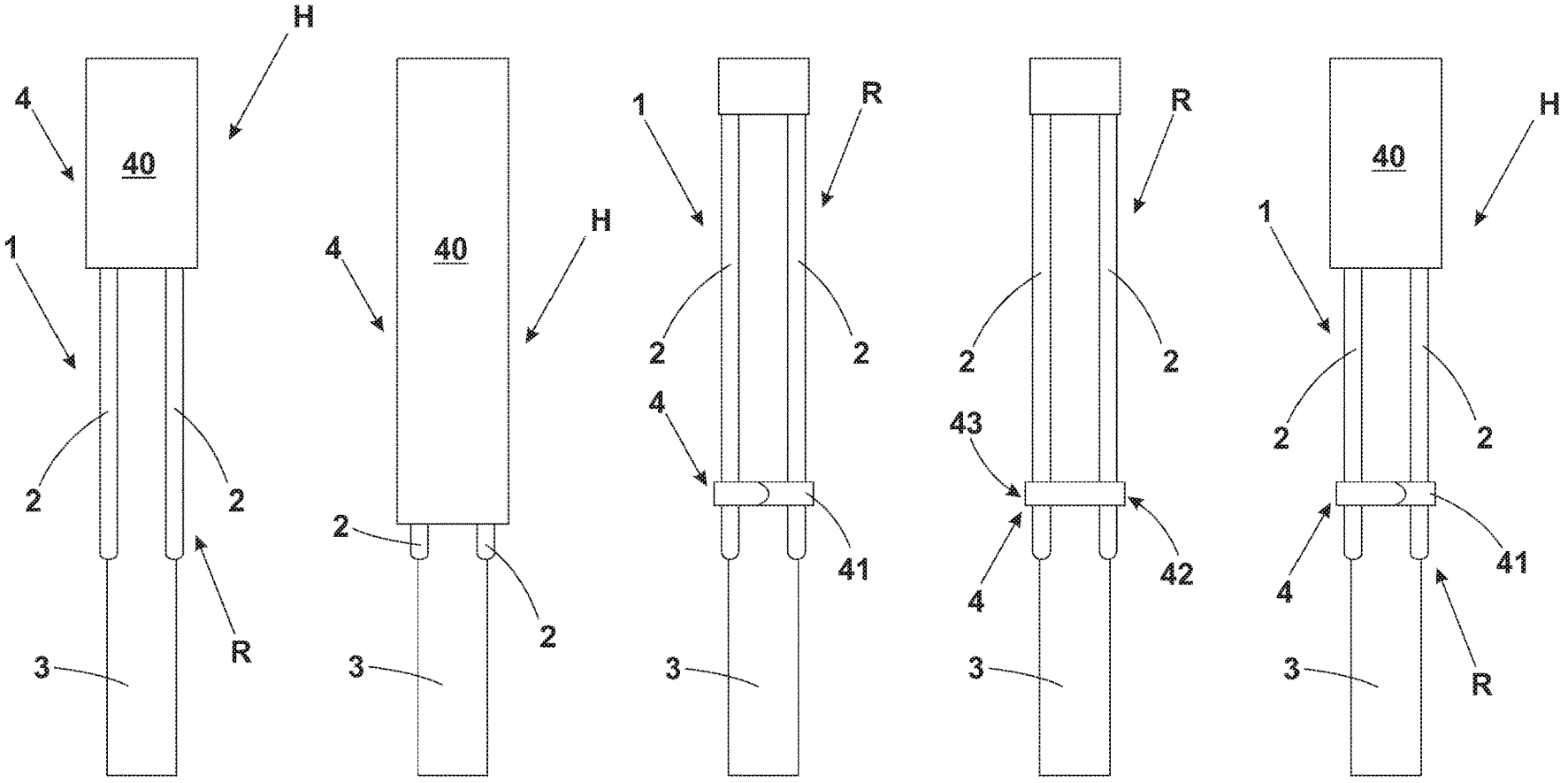
FIG. 3 shows a first embodiment of the means of stabilization that is made up of a tubular cap intended to be fitted on the main body, with movement from top to bottom, and with the cap made of semi-rigid material and with an axial length such as to partially cover the folded radiating elements.
FIG. 4 shows a variation of the embodiment of FIG. 3 with the cap made of floppy material with a greater axial length, so as to completely cover, or almost cover, the same radiating elements.
FIG. 5 shows a second embodiment, wherein the stabilization means is made of at least a band of flexible material, such as fabric, plastic, leather or the like, intended to wrap from the outside, in the form of a ring, the said radiant elements 2 near their end portions.
FIG. 6 shows both a third and a fourth embodiments of the stabilization means 4.
FIG. 7 shows a fifth embodiment of the means of stabilization, including the cap 40 shown in FIG. 3 in combination with the band 41 of FIG. 5.

Cap 40 can be made of semi-rigid material and with an axial length such as to partially cover the folded radiating elements 2 (FIG. 3), or of floppy material with a greater axial length, so as to completely cover, or almost cover, the same radiating elements (FIG. 4).

In a second embodiment, the stabilization means 4 are made up of at least a band 41 of flexible material, such as fabric, plastic, leather or the like, intended to wrap from the outside, in the form of a ring, the said radiant elements 2 near their end portions (FIG. 5).

Band 41 is equipped with joining devices (not shown in detail), designed to secure the edges in the said ring configuration, consisting for example of Velcro strips, snap buttons or the like.

The band 41 is preferably fixed to the main body 3, for example, at or near one of its ends, by means of a screw, or other fastening means, so as to be captive.

FIG. 6 shows both a third and a fourth embodiments of the stabilization means 4.

In the third embodiment, they consist of a rigid collar ring 42, fitted on said main body 3 and sliding axially with respect to the latter, with movement from top to bottom, so as to close the radiating elements 2, and in the opposite direction to release them.

In the fourth embodiment, the means of stabilization 4 are constituted by a sleeve 43 of elastic material, that can be worn on the main body 3 to close the radiating elements 2, or is removed therefrom to free them.

FIG. 7 shows a further possible embodiment of the means of stabilization 4, including the cap 40 shown in FIG. 3 in combination with the band 41 of FIG. 4.

In addition to the examples described and illustrated, other technical solutions are naturally possible for said means of stabilization 4, the removal of which, anyway, allows the radiating elements 2 to return spontaneously from the aforementioned folded position R, adhering to the main body 3, to the fan-like configuration X, thanks to the shape memory of their material.

According to a further embodiment of antenna 1 (see FIG. 1), the latter includes a base 5, adapted to fit the antenna into the ground and, in essence, the use as a stationary antenna.

In the above mentioned embodiment, the base 5 includes a hollow cylindrical body 51, with sufficient height and internal diameter to accommodate the lower part of the main body 3, and an anchorage 52, fixed to the lower part of the cylindrical body and capable of fitting the base 5 to the ground or to another supporting surface of antenna 1.

In particular, by way of example and not limited thereto, an anchorage 52 consisting of a tripod is shown, intended to be placed on the ground. Another example of anchorage 52, not shown because it is easy to understand, may be a stake, intended to be fitted into the ground.

According to the invention, the base 5 also includes a ground set of radial ribs 55, comprising a plurality of ribs 56 arranged in a fan-like fashion and fixed to the outer lateral surface of the cylindrical body 51. The ground set of radial ribs 55 if provided for acting as a reflective plane of antenna 1.

The ribs 56 that make up the ground set of radial ribs 55, in turn, are conveniently made of shape memory material, for example the same material with which the radiating elements 2 are made, so as to allow easy folding on the cylindrical body 51.

A shaped sheet 57 of non-rigid conductive material is preferably joined to the ground set of radial ribs 55 that is designed to operate as the most efficient ground plane for antenna 1.

From the above the peculiar and advantageous characteristics of the proposed improved satellite antenna are self-evident, as it can be set in operational position quickly and spontaneously, with the simple removal of the means of stabilization.

This important advantageous aspect is achieved with a simple technical solution and low cost, which allows, moreover, to obtain an antenna more compact and lighter than those made in accordance with the known technique, so that transport in the military field is made easier.

In particular, it should be noted that, when the embodiments of the means of stabilization including the cap are used, greater protection of the radiating elements, when placed in the closed position, can be obtained, thus avoiding possible damage to them.

Another advantage is given by the presence of the base 5 and the ground plane consisting of the ribs 55 and the sheet 57, which give the antenna 1 greater versatility of use and allow better definition of the characteristics of directionality.

It is understood, however, that what is described above is illustrative and not limiting, therefore any variations in detail that may be necessary for technical and/or functional reasons, both in the method and in the system, are considered from now on within the protective scope defined by the claims below.

The invention claimed is:

1. Improved portable satellite antenna, of the type including a main body (3), capable of containing electronics for adapting the same antenna (1) and means of connection to a SATCOM transceiver, and a plurality of radiating elements (2) fastened at one end of said main body (3) acting as a handle, fan-like extended from the handle in an operating condition (W) and foldable so as to adhere to the same main body (3) in a condition of non-use (H) of said satellite antenna (1), wherein said radiating elements (2) are made of flexible shape memory material; and they extend radially from said main body (3) when arranged in the operating condition (W), and foldable by flexing at said one end so as to adhere to the main body (3) in a folded position outside the main body (3) in the condition of non-use (H) of said satellite antenna (1);

means of stabilization (4) associated, either fixed or removable, with the said radiating elements (2) for definition and maintenance in said folded position (R) adhering to said main body (3), and wherein said radiating elements (2) return spontaneously to said fan-like radial configuration (X), corresponding to said operating condition (W) of said satellite antenna (1), as a result of a removal/opening of said means of stabilization (4).

2. The improved portable satellite antenna according to claim 1, wherein said radiating elements (2) are made of elastic metal, coated externally with plastic material.

3. The improved portable satellite antenna according to claim 2, wherein said metal is harmonic steel.

4. The improved portable satellite antenna according to claim 1, wherein said means of stabilization (4) consist of a tubular cap (40) configured for fitting on said main body (3), with movement from top to bottom, to carry and hold said radiating elements (2) in said folded position (R) adhering to the main body (3).

5. The improved portable satellite antenna according to claim 1, wherein said means of stabilization (4) consist of at least one band (41) of flexible material, configured to wrap from outside, in the form of a ring, so as to carry and hold said radiating elements (2) in said folded position (R) adhering to the main body (3), said band (41) equipped with joining means provided to bind edges of the band in said ring form.

6. The improved portable satellite antenna according to claim 1, wherein said means of stabilization (4) consist of a rigid collar ring (42), fitted on said main body (3) and sliding axially with respect to the main body, with movement from top to bottom, to carry and hold said radiating elements (2) in said folded position (R) adhering to the main body (3), or instead upwards to release the radiating elements and allow the radiating elements to return spontaneously to said radial configuration (X).

7. The improved portable satellite antenna according to claim 1, wherein said means of stabilization consist of a sleeve (43) of elastic material, configured to fit on said main body (3) to move and hold said radiating elements (2) into said folded position (R) adhering to the main body (3), or instead to release the radiating elements from the folded position and to return spontaneously to said fan-like radial configuration (X).

8. The improved portable satellite antenna according claim 1, wherein said radiating elements (2) are each doubled to form pairs of radiating elements, with each pair (2*a*, 2*b*) angularly equidistant from the other pairs, when arranged in said fan-like radial configuration (X), and wherein the radiating elements of each pair are substantially parallel and aligned on a same plane.

9. The improved portable satellite antenna according to claim 1, further including a base (5), for allowing a fastening to the ground, said base (5) comprising a cylindrical body (51), for accommodating the lower portion of said main body (3), and an anchorage (52), fastened to a lower part of said cylindrical body (51) for anchoring said base (5) to the ground, or to any other supporting surface of the antenna (1) itself.

10. The improved portable satellite antenna according to claim 9, further including a ground set of radial ribs (55), configured to act as a reflective plane for the antenna (1), fixed to an external surface of said cylindrical body (51).

11. The improved portable satellite antenna according to claim 10, wherein said ground set of radial ribs (55) comprises a plurality of ribs (56) made with shape memory material.

12. The improved portable satellite antenna according to claim 10, further including a shaped sheet (57) of non-rigid conductive material, joined to said ribs (56) in order to improve the characteristics of the reflective plane of said antenna (1).

13. The improved portable satellite antenna according to claim 1, wherein said definition and maintenance in said folded position (R) is by adhering said radiating elements to said main body (3) by holding said radiating elements fast by grasping said radiating elements outside the main body (3).

* * * * *